US011621134B1

(12) United States Patent
Cao et al.

(10) Patent No.: US 11,621,134 B1
(45) Date of Patent: Apr. 4, 2023

(54) HIGH SPEED SOLENOID DRIVER CIRCUIT

(71) Applicant: Smart Wires Inc., Union City, CA (US)

(72) Inventors: Liyu Cao, Fremont, CA (US); Amrit Iyer, Oakland, CA (US); Arthur Kelley, Cary, NC (US); Govind Chavan, Union City, CA (US)

(73) Assignee: Smart Wires Inc., Durham, NC (US)

( * ) Notice: Subject to any disclaimer, the term of this patent is extended or adjusted under 35 U.S.C. 154(b) by 123 days.

(21) Appl. No.: 17/249,282

(22) Filed: Feb. 25, 2021

Related U.S. Application Data

(60) Provisional application No. 63/033,702, filed on Jun. 2, 2020.

(51) Int. Cl.
*H01H 33/42* (2006.01)
*H01H 33/666* (2006.01)

(52) U.S. Cl.
CPC ..... *H01H 33/6664* (2013.01); *H01H 33/42* (2013.01); *H01H 33/6662* (2013.01)

(58) Field of Classification Search
CPC ..... H01H 33/6664; H01H 33/42; H01H 33/6662; H01H 47/00; H01H 47/32; H01H 3/3026; H01H 47/04; H01H 47/325; H01H 9/541
USPC ..... 335/6, 124, 203, 16, 149, 153, 38, 127, 335/128, 148; 361/155, 156, 160; 218/57; 310/120; 200/308
See application file for complete search history.

(56) References Cited

U.S. PATENT DOCUMENTS 3,064,165 A * 11/1962 Kennedy ..... H01H 47/04 361/205
3,549,955 A * 12/1970 Crawford ..... F02D 41/20 307/104
4,041,546 A * 8/1977 Stewart ..... H01H 47/325 361/152
4,453,652 A * 6/1984 Merkel ..... B05C 5/0225 222/504
4,757,418 A 7/1988 Bruckner
5,748,431 A 5/1998 Goodnight et al.
7,154,729 B2 12/2006 Tanzawa et al.
7,161,787 B2 * 1/2007 Joens ..... H03K 17/04106 361/160
7,212,090 B2 * 5/2007 Kadah ..... H01H 9/56 361/160

(Continued)

OTHER PUBLICATIONS

Analog Devices, "LT3751 High Voltage Capacitor Charger Controller with Regulation", 2017, 34 pp. total.

(Continued)

*Primary Examiner* — William A Bolton
(74) *Attorney, Agent, or Firm* — Womble Bond Dickinson (US) LLP

(57) ABSTRACT

A driver circuit for driving a solenoid, and related method, are described. A power supply charges one or more capacitors to a high voltage level sufficient to over-drive the solenoid. A switch is connected to the one or more capacitors and the solenoid. When the switch is on, the switch connects the one or more capacitors to the solenoid. When the switch is off, the switch disconnects the one or more capacitors from the solenoid. Control circuitry turns the switch on, and turns the switch off in response to sensing current through the solenoid reaches a defined maximum current.

23 Claims, 9 Drawing Sheets

(56) References Cited

U.S. PATENT DOCUMENTS

| | | | | |
|---|---|---|---|---|
| 8,887,758 | B2 * | 11/2014 | Kamada | F16K 37/0075 137/554 |
| 10,063,224 | B2 * | 8/2018 | Sato | H02M 3/158 |
| 10,404,180 | B2 * | 9/2019 | Greenwood | H02M 3/33507 |
| 10,825,625 | B1 | 11/2020 | Marshall et al. | |
| 2007/0188967 | A1 * | 8/2007 | Smith | H01F 7/1816 361/155 |
| 2017/0256974 | A1 | 9/2017 | Baker | |
| 2017/0330667 | A1 * | 11/2017 | Shutty | H01F 7/1805 |

OTHER PUBLICATIONS

Pithadia, Sanjay, "Driving solenoid coils efficiently in switchgear applications", Texas Instruments Incorporated, High-Performance Analog Products, Analog Applications Journal, Fourth Quarter 2013, pp. 27-32.

ST Microelectronics, "AN243 Application Note, Switch-mode drivers for solenoid driving", Nov. 2006, 19 pp. total.

Texas Instruments, "DRV110 120- and 230V AC, 6- to 48-V DC Current Controller for Solenoids, Relays and Valves", SLVSBA8G—Mar. 2012—Revised Mar. 2018, 29 pp. total.

* cited by examiner

HIGH SPEED SOLENOID DRIVER CIRCUIT

CROSS-REFERENCE TO RELATED APPLICATIONS

This application claims benefit of priority from U.S. Provisional Application No. 63/033,702 titled High Speed Solenoid Driver Circuit, filed Jun. 2, 2020, which is hereby incorporated by reference.

TECHNICAL FIELD

The present disclosure relates generally to circuit arrangements for actuating and holding the armatures of solenoids in an attracted position with an emphasis on effecting rapid actuation on one hand and reduced holding power on the other.

BACKGROUND

There are a variety of mechanical devices that may require a linear motion of millimeters to centimeters to effect the change from one state to the other. This may occur for a switch in which the linear motion changes its status from closed to open or from open to closed. One device that may be favorable for the electrical actuation of such a switch may be a solenoid, in which there may be an armature that may be moved by magnetic attraction between it and a stationary magnetic case by passing electric current through a coil. Further, once the actuation is complete, and the separation between armature and case has been minimized, it may be both desirable and possible to maintain that position by continuing to apply power at a level much lower than the actuating power because the magnetic reluctance of the actuated solenoid may be much lower than the open solenoid.

To recognize the requirements imposed on a solenoid driving circuit, it may be useful to consider a representative solenoid. FIG. 1 shows a schematic cross section 100 of a solenoid designed to actuate a vacuum interrupter, an example from U.S. patent application Ser. No. 16/570,858, entitled "Kinetic Actuator for Vacuum Interrupter." The key elements of this structure include a shaft 101 that imposes an axial motion to a switch, a vacuum interrupter in particular. This shaft 101 may be moved by a ferromagnetic armature 102, which in its non-activated condition, may be separated from a ferromagnetic case 104 by a distance 103. When activated, the distance 103 between the armature 102 and the case 104 may be reduced to zero. Closing that gap imposes an axial translation on the shaft 101. Actuation may be achieved by passing current through a solenoid coil 105. In this case, sustained activation may be maintained by current flow through the solenoid coil 105. Because the gap 103 between the armature 102 and the case 104 may be eliminated during activation, the magnetic reluctance may be reduced, and the solenoid coil 105 current required to overcome the force of a return spring 107 and a return spring 108 may be less than the current required to move the armature 102 from a fully separated position to a closed position. Using a low current for holding the solenoid in its actuated position may be beneficial for the obvious reasons of diminished power consumption and diminished heating. A ring of permanent magnets 106 may further reduce a holding current.

Considering the classes of switches that might be operated by such a solenoid, vacuum interrupters, circuit breakers and other switches in critical safety roles may require fast operation to assure the minimization of electrical, thermal and human hazard. It is the purpose of the embodiments of the invention to address these problems by the structure and design of an actuating circuit for the driving solenoids.

SUMMARY

In one embodiment, a driver circuit is for driving a solenoid. A capacitor is connectable to a first power supply to charge the capacitor to a high voltage level sufficient to over-drive the solenoid. A switch is connected to the capacitor. The switch is connectable to the solenoid. The switch is to connect the capacitor to the solenoid when the switch is on, and disconnect the capacitor from the solenoid when the switch is off. Control circuitry is to turn the switch on, and turn the switch off in response to sensing current through the solenoid reaches a defined maximum current.

In one embodiment, a driver circuit is for driving a solenoid. The driver circuit includes one or more capacitors, a first power supply, a second power supply, a switch, and control circuitry. The first power supply is coupled to the capacitor to charge the one or more capacitors to a high voltage level sufficient to over-drive the solenoid. The second power supply is to supply a holding current to the solenoid. The switch is connected to the one or more capacitors. The switch is connectable to the solenoid. Control circuitry is to turn the switch on so that the switch connects the one or more capacitors and the solenoid. The control circuitry is to turn the switch off so that the switch disconnects the one or more capacitors in response to determining current through the solenoid achieves a defined maximum current.

One embodiment is a method of driving a solenoid. The method includes charging one or more capacitors to a high voltage level sufficient to over-drive the solenoid. The method includes turning a switch on, so that the switch connects the one or more capacitors to the solenoid. The method includes turning the switch off, so that the switch disconnects the one or more capacitors from the solenoid, in response to sensing current through the solenoid reaches a defined maximum current. The method includes repeating the turning the switch on and the turning the switch off, until the solenoid reaches an actuated state. The method includes providing a holding current to the solenoid, with the solenoid in the actuated state.

Other aspects and advantages of the embodiments will become apparent from the following detailed description taken in conjunction with the accompanying drawings which illustrate, by way of example, the principles of the described embodiments.

BRIEF DESCRIPTION OF THE DRAWINGS

The subject matter that is regarded as the embodiments of the invention is particularly pointed out and distinctly claimed in the claims at the conclusion of the specification. The foregoing and other objects, features, and advantages of the invention will be apparent from the following detailed description taken in conjunction with the accompanying drawings.

DETAILED DESCRIPTION

A driver circuit is described that is capable of driving a solenoid to achieve a high actuation speed and then holding the solenoid in its actuated condition using a low capacity power supply. The actuation energy for this driver is derived from a capacitor bank that is charged to a high voltage level, and the solenoid is protected by interrupting the driving current every time it achieves a designed maximum value. The current is restarted by a clock operating with a fixed period.

Figure 1:
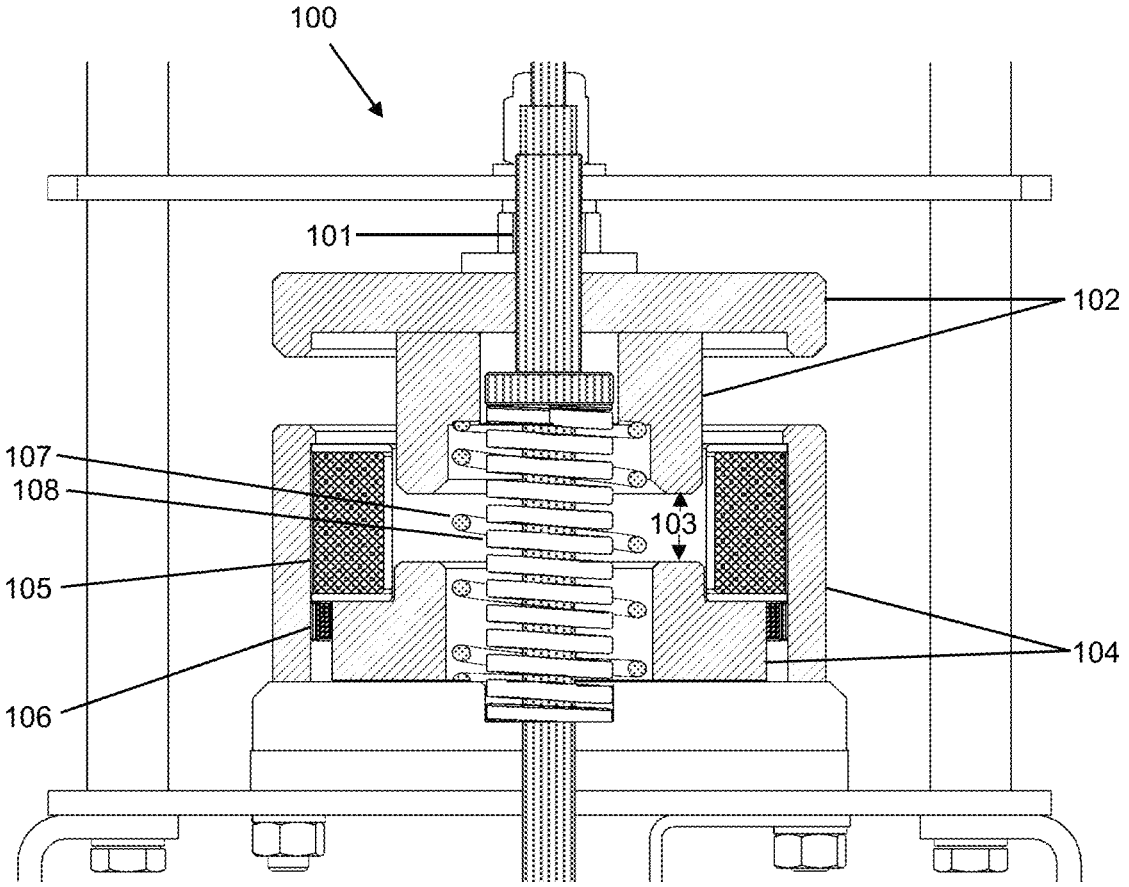
FIG. 1 shows the cross section of a prior art representative solenoid with a single coil both for actuation and for maintaining the actuated state.

Various embodiments of a drive circuit described herein may address the basic needs of driving a solenoid 100 exemplified by FIG. 1, supporting two levels of current, one for actuation and one for holding the solenoid in its actuated condition. However, the drive circuit design may also address the need for fast actuation that arises in electric power distribution and in other roles or applications where system performance, system security, human safety and public safety depend upon prompt switch actuation.

As viewed from the driving circuit, a solenoid coil 105 may have two critical characteristics, its resistance R and its inductance L. From the point of view of accelerating actuation, another parameter may become important, a maximum current $I_{MAX}$ that the solenoid can tolerate. In order to have the quickest possible actuation, the driver may deliver maximum current $I_{MAX}$ promptly to supply the maximum accelerating force to the armature 102 and the drive rod 101. Force may be important because the moving elements all have mass, and the net force applied to accelerate this mass may be diminished by the return springs 107 and 108.

The inductance L of the solenoid may not be constant, because, as the gap 103 closes, the reluctance of the magnetic path may be diminished, and the inductance may increase. The inductance range may be considerable, for example with the final inductance of the activated solenoid several times the initial inductance. The inductance L may be a function of the dimensions of the solenoid winding and the number of turns, as well as the size and materials of the magnetic circuit formed by armature 102, case 104, and the gap 103.

The resistance R of the solenoid may be determined by the characteristics of the solenoid coil 105, including a total wire length, a gauge, and a material composition of the wire. The maximum current $I_{MAX}$ may also be determined by the wire gauge and material. Further, the mechanical structure may have some effect on $I_{MAX}$.

An initial inductance L0 may be an important parameter because, prior to activation, there may be no current flowing in the coil of the solenoid. The inductance L0 may oppose establishing a high current in the solenoid coil by an opposing voltage L0*(di/dt), where i may be the dynamic current passing through the solenoid coil, and (di/dt) may be its time derivative. In order to realize a high value of (di/dt), a high voltage may be applied to the solenoid. In order to illustrate the scale of effect, consider two generalized characteristics of a solenoid. The first may be an initial time constant T0, which may be L0/R, and the second may be a characteristic voltage V0, which may be $R*I_{MAX}$.

Figure 2:
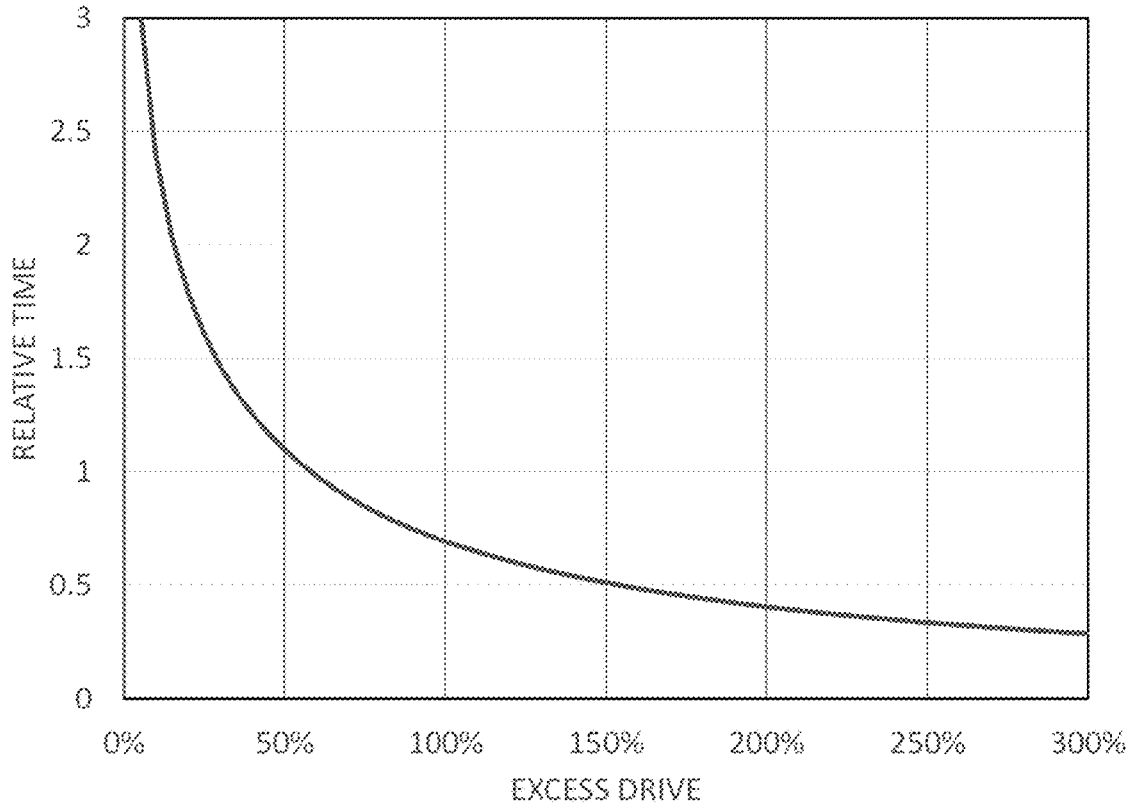
FIG. 2 shows the effect of using excess voltage to speed up the achievement of maximum drive current in a solenoid.

FIG. 2 relates the time to achieve $I_{MAX}$ in units of T0 to the Excess Drive voltage, defined as (V−V0)/V0. Roughly speaking, to achieve $I_{MAX}$ in a time equivalent to T0, Excess Drive may be about 60%, meaning the driving voltage may be about 1.6 times V0. If the drive voltage is several times V0, $I_{MAX}$ can be achieved in less than half T0. To put scale on these numbers, for a large, power transmission solenoid, L0 might be around 10 mH, and R could be near 2 ohms. That gives T0 a value of 5 msec. If $I_{MAX}$ for this device is 50 A, then V0 could be 100 volts. These numbers are illustrative, and they could vary by orders of magnitude or more, depending upon the design of the solenoid.

To establish a maximum drive current in a time that may be less than T0, FIG. 2 shows there may be a need for a high drive voltage, two or more times V0. As an example, to achieve a maximum drive current in a time of one half of T0, a voltage 2.54 times V0 may be required, equivalent to an overdrive of 154%.

Figure 3:
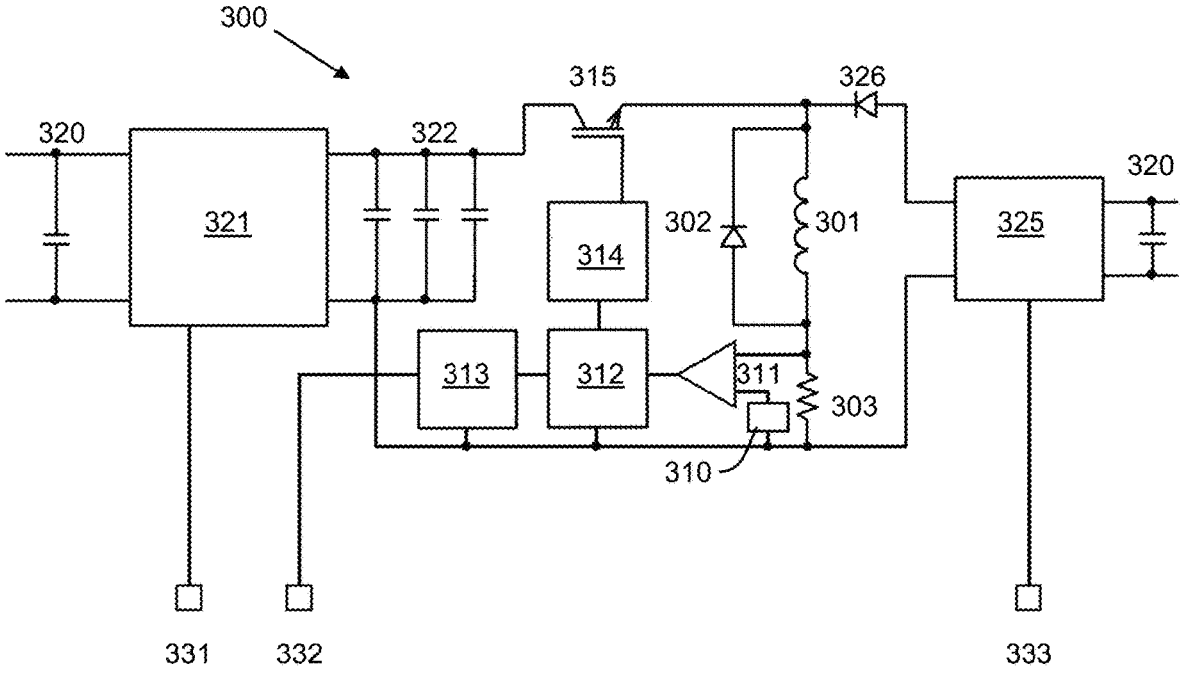
FIG. 3 shows a block diagram of one embodiment of the driver circuit, with connections for charge capacitor command, activate turn-on command, current sensing port and hold current command.

FIG. 3 shows a block diagram of a driver circuit 300, as an embodiment of a circuit to accomplish that end while avoiding destructive overdriving on one hand and supporting low power for holding the solenoid in its actuated condition on the other.

In FIG. 3, there are several clusters of elements. First the solenoid related elements range from 301 through 303. Sensing resistor 303 is for sensing current through the solenoid coil 105, for example through voltage measurement across sensing resistor 303. Solenoid inductor 301 represents the inductance of the solenoid coil 105, which could be of variable inductance as described above. Diode 302 is a bypass diode of the solenoid. The current control elements range from 310 through 315. The actuation power supply comprises elements 321 and 322, i.e., power supply 321 and capacitor bank 322, and the holding power supply comprises elements 325 and 326, i.e., power supply 325 and power supply output diode 326. Elements 331, 332 and 333 are ports 331, 332, 333 for input of external control signals.

As discussed above, a high voltage may be applied to the solenoid to apply a maximum actuating force in a time which may be small relative to the characteristic time of the solenoid, T0=L0/R. As noted above, a target time of T0/2 may require 2.54 times the nominal maximum voltage for the solenoid inductor 301. Unchecked, this high voltage may be capable of destroying the solenoid inductor 301, i.e., destroying the solenoid coil 105. The current through the solenoid may be monitored by a sensing resistor 303, and the voltage across that sensing resistor 303 enters the current control elements, in comparison with a reference voltage 310. It should be appreciated that the sensing resistor 303, and resistance of the sensing resistor 303, should not be confused with the characteristic resistance R of the solenoid coil 105 discussed above. Element 311 may be a comparator 311, which for the purposes of this discussion, makes a low-to-high transition when the voltage across the sensing resistor 303 exceeds a reference voltage 310. These elements, sensing resistor 303 and reference voltage 310, are calibrated so that the comparator 311 makes the voltage transition when the current through the solenoid reaches $I_{MAX}$. This voltage transition may be applied to a logic block 312, and it causes a gate driver 314 to eliminate the drive to a high current semiconductor switching device, switch 315, shown in FIG. 3 as an insulated gate bipolar transistor (IGBT). Without the gate drive, current flow from the actuating power supply, i.e., power supply 321 and capacitor bank 322 ceases, so the current through the solenoid, i.e., current through solenoid inductor 301, does not exceed $I_{MAX}$. Further mechanisms for sensing current through the solenoid 100, more specifically through the solenoid inductor 301, such as Hall effect sensors, inductive sensors, magnetic field sensors, etc., and appropriate amplification and/or comparison circuits, or analog-to-digital conversion, are readily devised in keeping with the teachings herein. The comparator 311 may have hysteresis, smoothing or noise reduction circuitry in some embodiments. There may be a digital equivalent, or mixed analog and digital equivalent circuit, in further embodiments.

Rapidly discontinuing current flow in an inductor, that is the solenoid inductor 301, may create a voltage transient opposite in sense and greater in magnitude than the prior applied voltage, but a bypass diode 302 allows the current to continue flowing, and that current flow decays with a time constant somewhat less than T0. A deviation from T0 comes about because there may be a finite voltage drop across the bypass diode 302.

Figure 5:
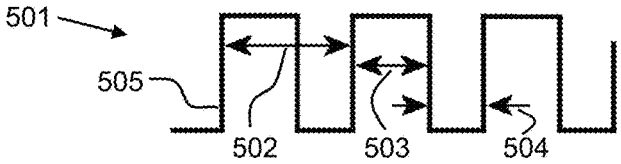
FIG. 5 shows a representative clock waveform and two choices of clock logic associated with IGBT gate drive, with (FIG. 5A) the gate drive turned on by the rising edge of the clock and turned off by the rising edge of the peak current sensing, or (FIG. 5B) turned off by either the rising edge of the peak current sensing or by the falling edge of the clock.

The current decay does not continue indefinitely, because the control logic block 312 may also be driven by a clock 313. This clock 313 may produce a clock signal in the form of a square wave or a series of pulses with a duty factor. The clock 313 may operate at a fixed frequency f. An illustrative clock signal 501 appears in FIG. 5. The clock may be characterized by a period t 502, which may be the time between two successive rising edges 505. The period t may be equal to 1/f. The clock's duty cycle may be the ratio of the active time 503 to the period t 502. This presumes an active high definition. Clocks may be designed to have their high state or a low state represent an active condition.

An example logic function in logic block 312 would respond to an upward transition, rising edge 505 in a clock signal 501 by turning the gate driver 314 on, turning the switching device, i.e., switch 315, on and allowing current flow from the actuating power source, i.e., power supply 321, capacitor bank 322. This logic may be illustrated in FIG. 5A, where a rising clock pulse turns the gate drive ON, but a rising $I_{MAX}$ pulse turns the gate drive OFF. An abbreviated description of this logic may be edge activation.

Returning to FIG. 3, the actuation energy may be stored in a capacitor, or more typically a capacitor bank 322, and that capacitor bank may be charged by a voltage booster, e.g., power supply 321 capable of delivering a high voltage to charge the capacitors. A flyback power supply may be a representative voltage booster, e.g., power supply 321. Typical voltages would be several times $V0=R*I_{MAX}$, for example up to 500 volts for solenoids intended to drive large vacuum interrupters. The voltage booster, e.g., power supply 321 may be powered by a system power source 320, which might have a potential between 10 volts and 30 volts in various embodiments.

That same system power source 320 supplies a holding power supply 325, in one embodiment. That power supply may be either voltage or current regulated, and it comes into play when the voltage or current in the solenoid inductor 301, i.e., solenoid coil 105, drops into its compliance range, allowing the holding current to flow through a diode 326 and into the solenoid inductor 301. The voltage or current of the holding power supply 325 may be designed to meet the holding current requirements of the actuated solenoid, typically a fraction of $I_{MAX}$, for example 5% to 20%, depending upon the design of the solenoid, and more particularly design of the solenoid inductor 301. There could be separate power sources in further embodiments.

Several external signals control this driver. A first signal to port 331 may activate the voltage booster, e.g., power supply 321 to charge the capacitor bank 322 to the desired voltage. A second signal that is input to port 332 may empower the actuation of the solenoid, either through a logical AND function with the clock 313 or by turning the clock 313 on. This actuate signal to port 332 will be maintained until the solenoid represented by inductor 301 has reached its fully actuated, holding position. This may be determined by a period of time, by a number of clock pulses, or by signal from a position sensor built into the solenoid.

A controlling signal that is input to port 333 may enable the hold function by turning the hold power supply 325 on. During actuation, the diode 326 may act to isolate the hold power supply 325 from the high voltages needed for high-speed actuation. For actuation, the hold enable signal that is input to port 333 may be turned on as the actuation enable signal that is input to port 332 may be turned off. In further embodiments, a switch may be used instead of or in addition to the diode 326, for the hold function to connect the hold power supply 325 to the solenoid coil 105. Further, the hold enable signal that is input to port 333 may be the primary control when the solenoid coil 105 represented by inductor 301 may be de-activated; turning the hold enable signal to port 333 off may disable the holding current through the solenoid coil 105, e.g., inductor 301, which may allow the return springs 107 and 108 to move the armature 102 away from the case 104. This transition returns the mechanism, typically a switch, that the drive rod 101 controls to its non-actuated condition. This may be also the condition that the mechanism would take if there were no power applied to the overall system.

The flow of current from the capacitor bank 322 may be controlled by the high-current semiconductor switch 315. FIG. 3 illustrates that switch 315 as an insulated gate bipolar transistor, but an MOS field effect transistor or other suitable transistor may be used in various embodiments. A requirement may be the ability of this switch to interrupt the flow of current, and its current and voltage ratings must suit this application. The gate driver 314 may suit the selected device type.

Figure 4:
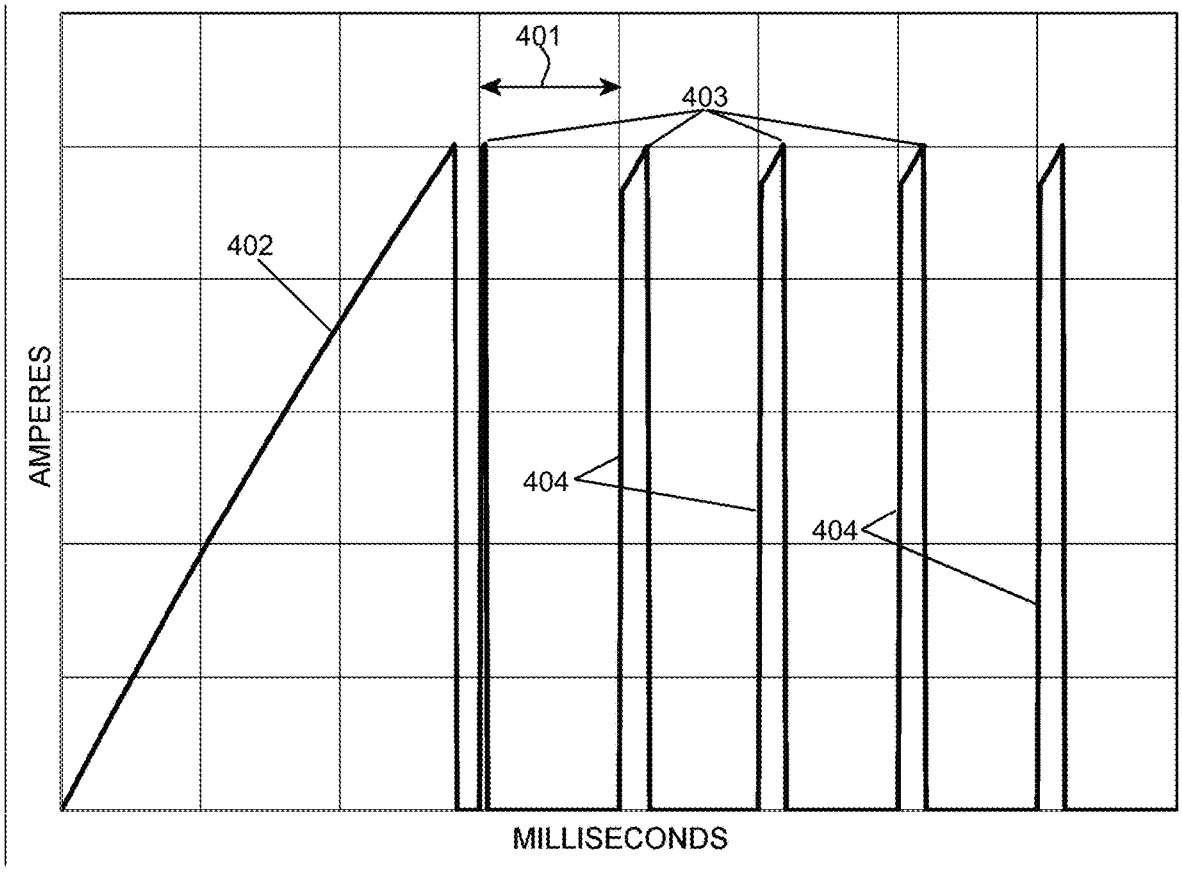
FIG. 4 shows estimated drive current from a capacitor bank through the IGBT and into a solenoid with a time constant L/R that may be long compared to clock period, and edge enabled clocking.

FIG. 4 may be an approximate representation of the current flow from the capacitor bank 322 in FIG. 3 to the solenoid, or more particularly to the solenoid inductor 301, in a case where the clock 313 has a period that may be less than the characteristic time TO of the solenoid inductor 301.

Note the clock period may be fixed and indicated by time span 401. The initial charging, by current rise 402 up to $I_{MAX}$ 403 extends over multiple clock periods, but subsequent current surges achieve $I_{MAX}$ in less than a single clock period. This current curve may be consistent with the logic illustrated in FIG. 5A, in which the gate drive may be turned on by an upward transition of the clock signal. This turn-on may be edge enabled. Edge enabled means that the turn-on may be initiated by the transition, in this case from a low voltage to a higher voltage signal, rather than by the specific amplitude of the signals. In that same figure, $I_{MAX}$ represents an upward transition coming from the comparator 311 in FIG. 3 when the current through the solenoid, or more particularly current through the solenoid inductor 301, reaches its maximum value, as set by the sensing resistor 303 and the reference voltage 310. The $I_{MAX}$ transition turns the gate drive to the IGBT, e.g., switch 315 off, interrupting the current flow from the capacitor bank 322. The logic in logic block 312 and the comparator 311 may be alternatively designed so that achieving $I_{MAX}$ generates a downward transition that interrupts the current flow.

Figure 6:
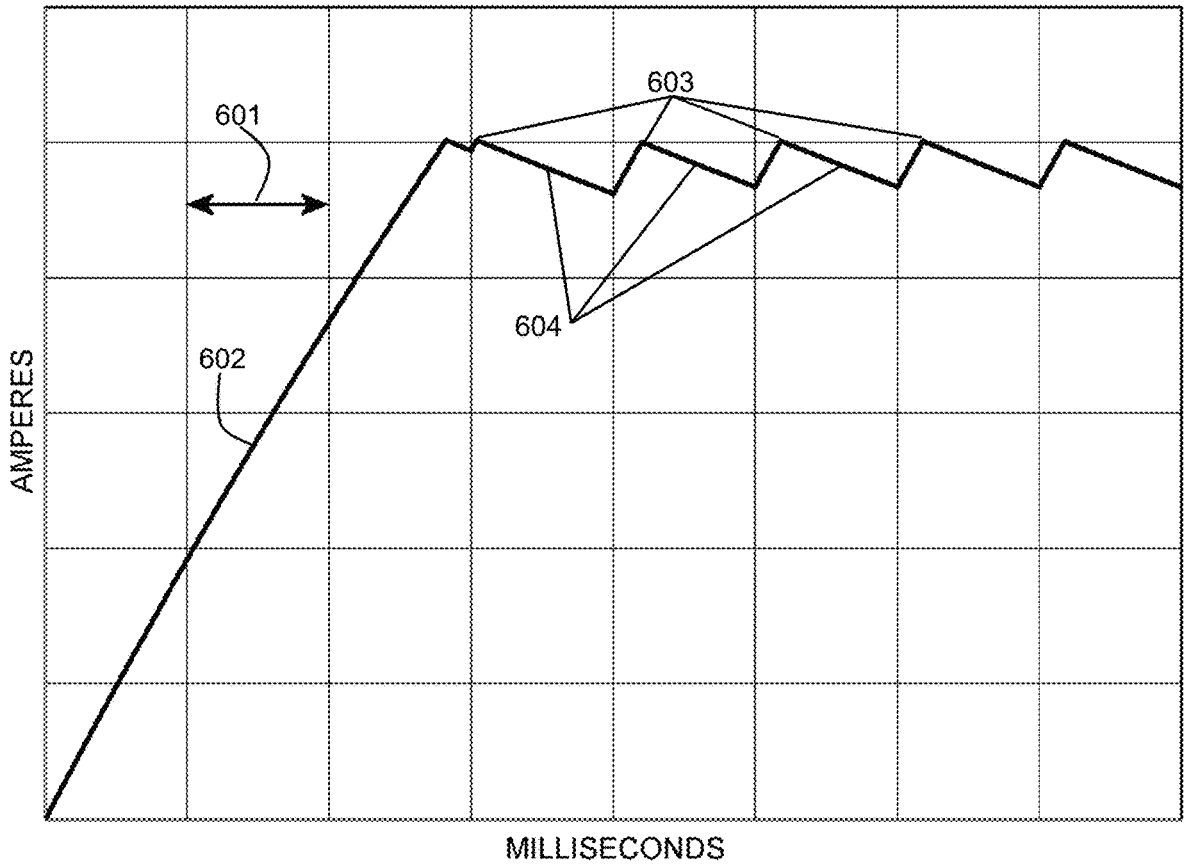
FIG. 6 shows the estimated current flowing through a solenoid with time constant L/R that may be long compared to clock period, and using edge enabled clocking.

Once the current flow from the capacitor bank 322 is interrupted, current may continue to flow in the solenoid inductor 301, now taking a path through the bypass diode 302. This current flow decays with a time constant shorter than the characteristic time TO of the solenoid inductor 301 because of the finite voltage drop across the bypass diode 302. The current flow through the solenoid, more specifically through the solenoid inductor 301 is illustrated in FIG. 6 as an example. The clock period is indicated by time span 601, and the initial current rise 602 may be identical, apart from leakage currents that should be negligible, to the current rise 402 from the capacitor bank 322, as illustrated in FIG. 4. The big difference may be the residual current 604 that continues to flow through the solenoid coil, e.g., solenoid inductor 301, and the diode 302. This current flow would assure continuing magnetic force applied to the armature (e.g., armature 102 in FIG. 1) even though the capacitor bank 322 may be isolated by the switch 315.

In FIGS. 4 and 6, the current curves are approximate because their function may be to illustrate the principles of the described solenoid driver circuit 300. There may be no attempt to illustrate the time-varying nature of the solenoid's 301 inductance, nor is the voltage drop across the bypass diode 302 accurately modeled. The current scales and time scales may depend upon the particular solenoid inductor 301 characteristics. For a heavy current solenoid, the value of $I_{MAX}$, for example, may be between 20 amperes and 100 amperes. Such a solenoid may have a resistance of 1 to 5 ohms as an example, and its initial, minimum inductance may range from 5 to 50 milli-Henrys. In one embodiment, representative TO values may be in the range of 1 to 20 milliseconds. Lighter duty relays may have lower values of $I_{MAX}$ and higher inductance and resistance values. The TO values, based on L/R ratios, may be in the range of milliseconds. FIG. 4 shows, after an initial rise 402 to $I_{MAX}$ 403, the current may be delivered in pulses 404, each terminated when $I_{MAX}$ 403 is reached. These pulses may continue until the ferromagnetic armature 102 is in contact with the ferromagnetic case 104. In some instances, additional pulses may be applied to assure complete actuation. The time to reduce the separation of gap 103 in FIG. 1 from its maximum value to zero may be defined as the actuation period.

Figure 7:
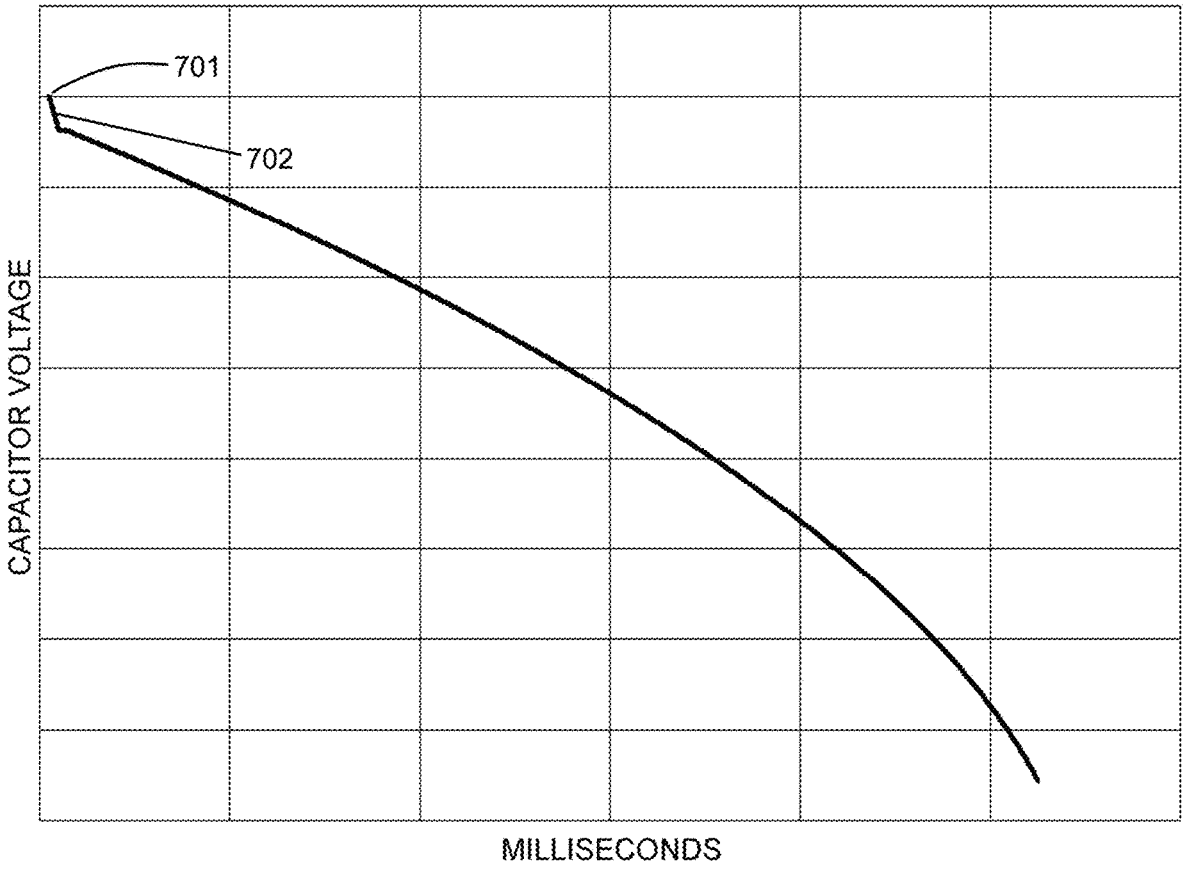
FIG. 7 shows the voltage decay of the capacitor bank associated with the current delivery in FIG. 4.

In this driver circuit 300, the capacitor bank 322 may be scaled so that the available energy ½ $CV/^2$ may be sufficient to fully actuate the mechanism that the solenoid is driving. The stored energy may be at its peak prior to starting the actuation, and it decays as current may be delivered to the solenoid. This is illustrated in FIG. 7, which illustrates the exhaustion of the stored energy by a curve of the voltage across the capacitor bank 322 in FIG. 3.

The initial voltage 701 depends upon the solenoid inductor 301, particularly upon its inductance, but the voltage may be high in order to establish the current quickly, as illustrated in FIG. 2. Representative maximum voltages can range, for example, from 100 to 500 volts. In FIG. 7, the initial voltage is indicated as initial voltage 701, and the rapid decay region 702 corresponds to the establishing the initial solenoid current as represented by the region showing current rise 402 in FIG. 4. The total decay time may depend upon the solenoid inductor 301 inductance and resistance and on the overall system design. The actuation time for representative solenoids, for example, can range from 10 msec to 100 msec, and the total voltage decay time must exceed the actuation time. These times may be hundreds of clock periods in some embodiments.

Figure 5A:
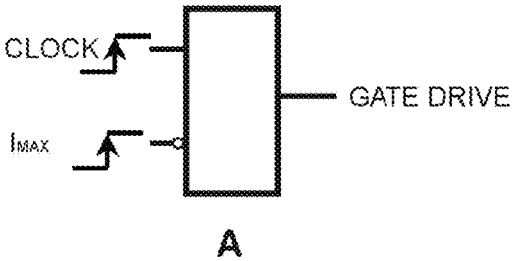

The discussion above describes a particular form of logic combining a fixed-frequency clock signal with the $I_{MAX}$ signal to manage the gate drive for the current switch 315 in FIG. 3. This logic may be illustrated by FIG. 5A. and the selected clock period may be small compared to the shortest characteristic time TO of the solenoid. This combination may provide rapid establishment of $I_{MAX}$ and relatively modest current decay between drive current pulses. In one embodiment, the control circuitry shown in FIG. 5A is clocked and edge enabled, and samples a signal (e.g., output of comparator 311 in FIG. 3) that determines the current through the solenoid reaches a defined maximum current.

Figure 5B:
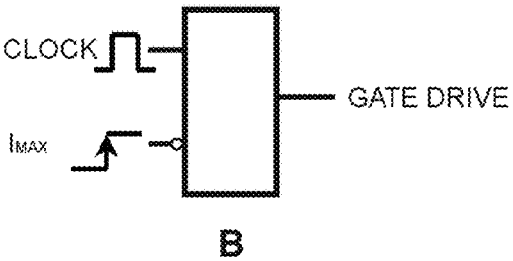

A first alternative embodiment may use the logic of FIG. 5B to integrate the clock and $I_{MAX}$ signals. Current may only flow while the clock signal may be in its active state, e.g., high (or low, as implementation-specific). The gate drive may be amplitude-enabled, thereby turning on with the rise of the clock signal and turning off with the fall of the clock signal. This means that the initial current rise may be chopped, which may extend the total time to initially establish $I_{MAX}$. In one embodiment, the control circuitry shown in FIG. 5B is enabled by an amplitude of a clock signal and an output of a comparator (e.g., output of comparator 311 in FIG. 3) that determines the current through the solenoid reaches a defined maximum current.

Figure 8:
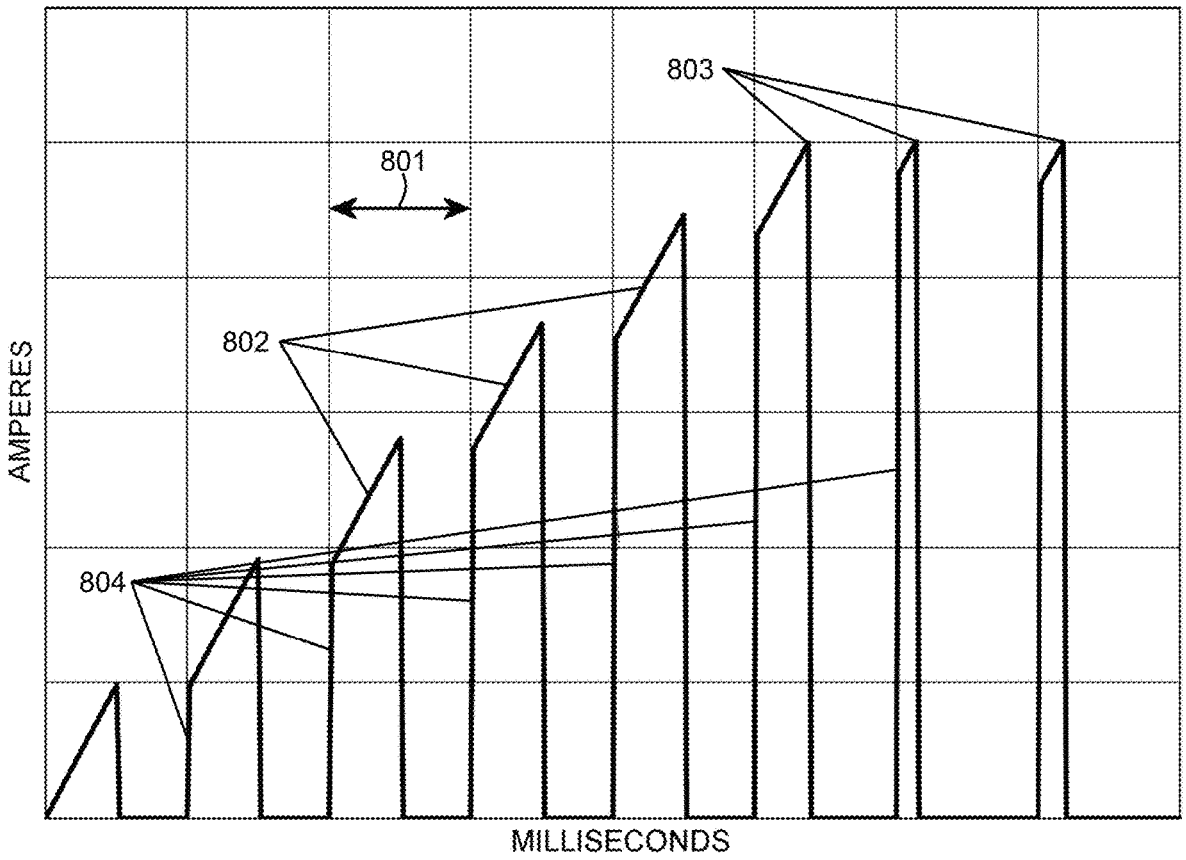
FIG. 8 shows estimated drive current from a capacitor bank through the IGBT into a solenoid with a time constant L/R that may be long compared to clock period, and using amplitude enabled clocking.

The curve of current flowing from the capacitor 322 through the switch 315 for this case, using a clock with an example 50% duty cycle, appears in FIG. 8. This figure applies to a case where the clock period 801 may be less than the characteristic time T0=L0/R. The initial rise 802 may be interrupted one or more times before the current reaches the limit $I_{MAX}$ 803. This means that the drive current into the solenoid inductor 301 may be a series of pulses, terminated prior to first achieving $I_{MAX}$ by the clock and subsequently by reaching $I_{MAX}$.

Figure 9:
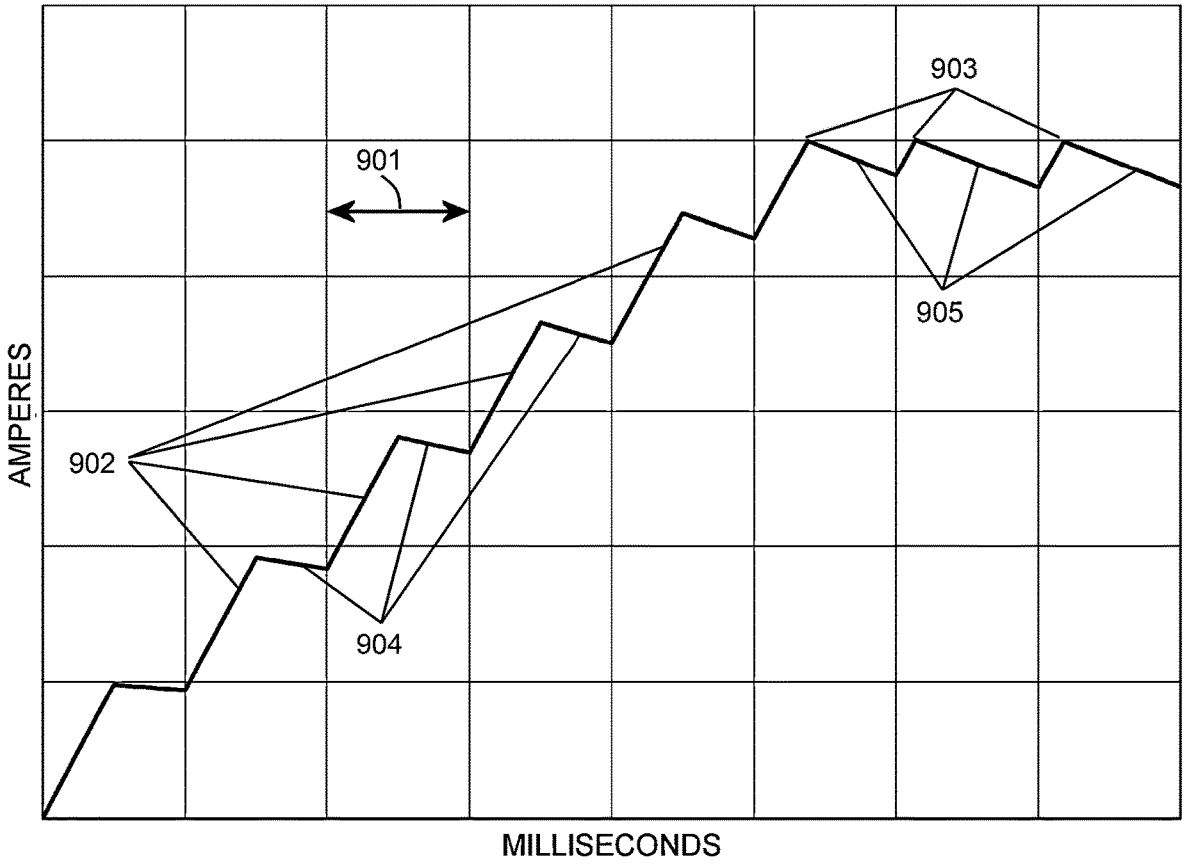
FIG. 9 shows the estimated current flowing through a solenoid with time constant L/R that may be long compared to clock period, and using amplitude enabled clocking.

The corresponding current flowing through the solenoid is shown in FIG. 9. Again, the clock period is indicated by time span 901, and while the initial current rise 902 occurs in segments, the current flow continues, with current decay 904, because of the shunt diode 302 returning current to the solenoid coil 105. After the current $I_{MAX}$ 903 is achieved, the current pattern, with current decay 905 may be similar to that seen in the case where the clock logic may be edge activated as in FIG. 5A. While FIGS. 8 and 9 portray a clock that has a duty cycle of 50%, this is merely an example and any other duty cycle would give similar characteristics, modified by the amount of time the current may be allowed to flow.

Figure 10:
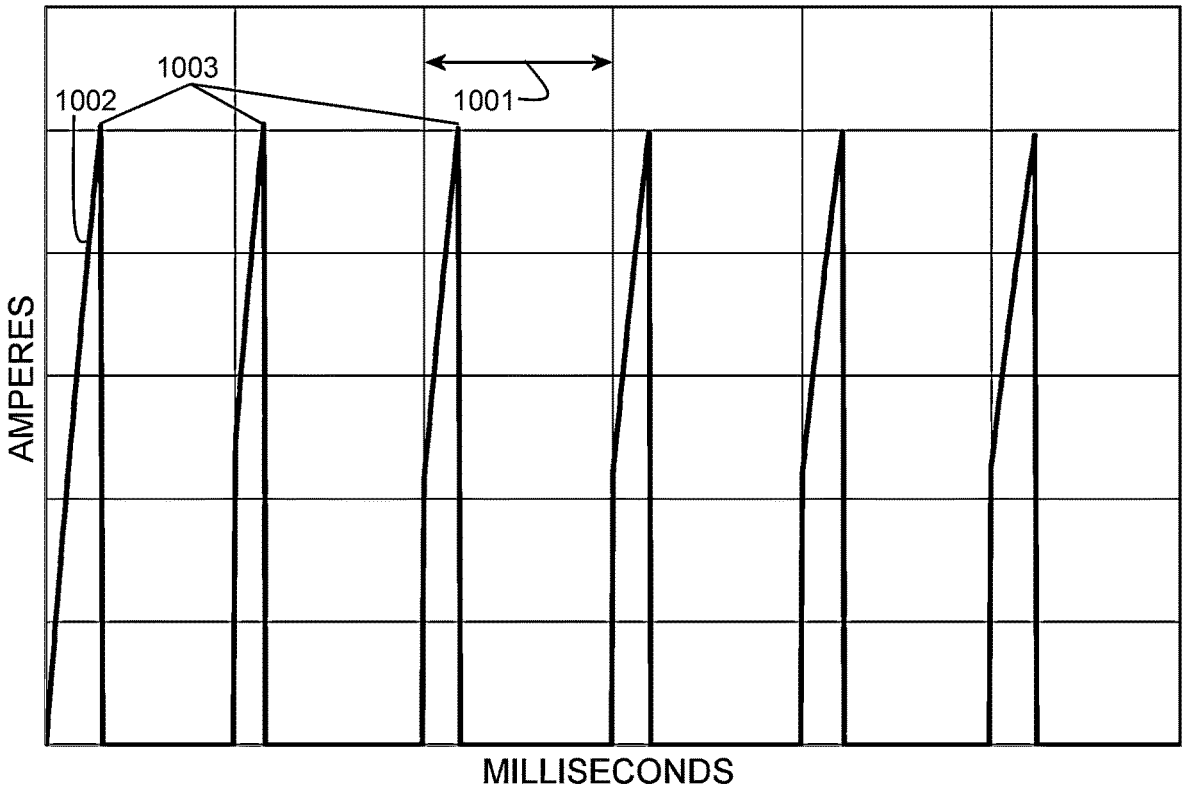
FIG. 10 shows estimated drive current from a capacitor bank through the IGBT into a solenoid with a time constant L/R that may be short compared to the clock period.
Figure 11:
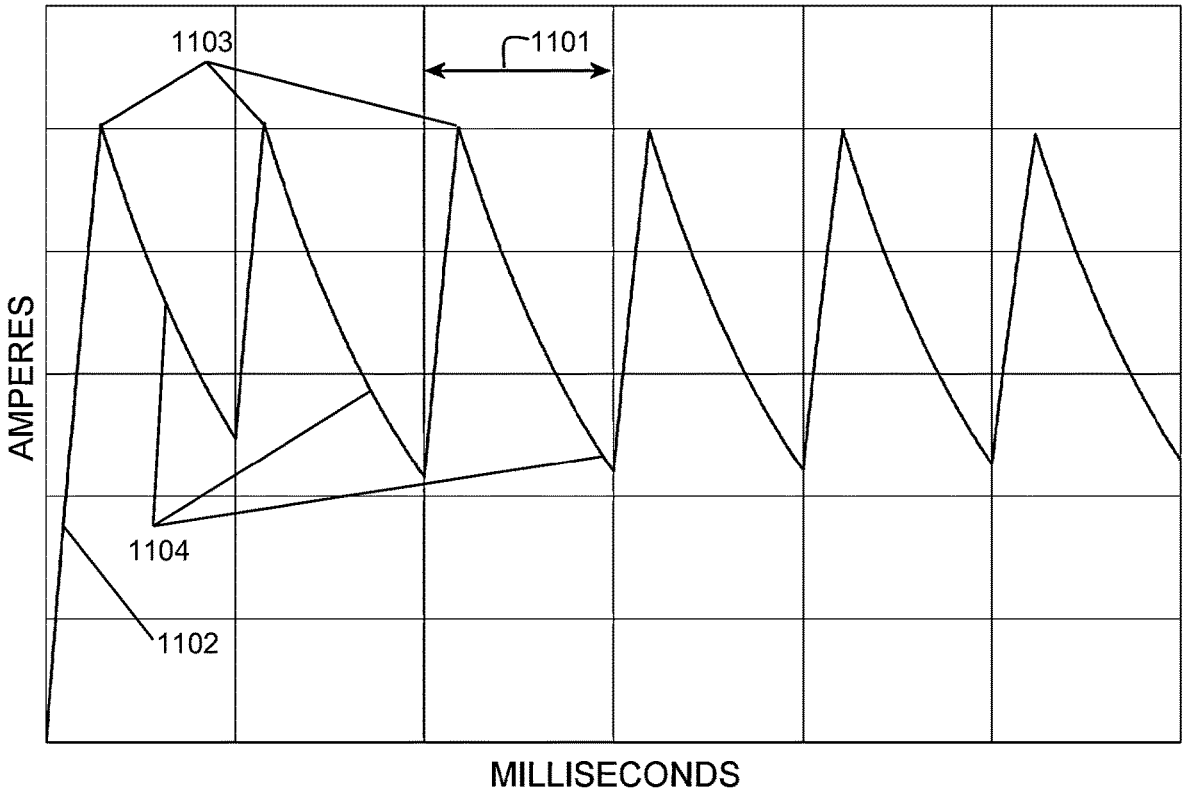
FIG. 11 shows the estimated current flowing through a solenoid with time constant L/R that may be short compared to the clock period.

As a second alternative embodiment, the design choice may be selecting a clock period that may be in excess of, for instance twice the characteristic time T0=L0/R. In this way, the initial current ramp might take place within the initial clock period. This is illustrated in FIGS. 10 and 11. In FIG. 10, the clock period 1001 may be long enough that the initial current rise 1002 to maximum current $I_{MAX}$ 1003 may be completed within the first clock period. As shown in FIG. 11, after the initial current rise 1102 and subsequent current rises, the current decay 1104 of current within a clock period 1101 can be a large fraction of $I_{MAX}$ 1103. The embodiments with shorter clock periods offer higher average actuating current, which translates to a higher average force to move the armature (e.g., armature 102 in FIG. 1), and consequently a shorter actuation time.

Solenoid actuators, like that illustrated as solenoid 100 in FIG. 1, may be placed in environments that experience significant temperature extremes. The resistance of the solenoid coil 105 may vary by about 25% over a temperature range from −15° C. to 50° C. as an example. Since the driver control may be based on current flow, the resistance changes may have a modest effect on the solenoid performance. Temperature and other environmental conditions may affect the properties of the magnetic circuit, including the armature 102 and the case 104. Further, there could be changes in the current handling capability of the solenoid. To the extent that these changes affect $I_{MAX}$, they may be compensated by making the reference voltage 310 a function of temperature, or any other measurable or predictable environmental factor.

In addition to relatively static conditions, like ambient temperature, the reference voltage 310 may be controlled on a dynamic basis in order modify the peak current $I_{MAX}$ to compensate for variations in the mechanical performance of the actuator, solenoid 100 for example, and its load. This may require feedback of information on the velocity of the actuator's armature 102 in FIG. 1 Alternatively, the reference voltage 310 may be profiled during the actuation period, i.e., the time that the ferromagnetic armature 102 requires to move from its open position to contact with the ferromagnetic case 104, to modify the peak actuating current according to a predicted current profile that optimizes the service lifetime of the mechanical load being driven by the motion of the solenoid.

The embodiments of the disclosure as described above are merely examples and should not be considered as limiting. A practitioner of the art will be able to understand and modify the embodiments of the disclosure to include other modifications that can influence the characteristics of the circuits and tailor them to specific purposes while retaining the concepts and teachings disclosed herein. Accordingly, the invention should only be limited by the claims included herewith.

What is claimed is:

1. A driver circuit for driving a solenoid, comprising:

one or more capacitors connectable to a first power supply to charge the one or more capacitors to a high voltage level to over-drive the solenoid;

a switch connected to the one or more capacitors and connectable to the solenoid, to connect the one or more capacitors to the solenoid when the switch is on, and disconnect the one or more capacitors from the solenoid when the switch is off; and control circuitry to turn the switch on, and to turn the switch off in response to a sensed current through the solenoid that reaches a defined maximum current;

wherein the control circuitry to turn the switch on is edge enabled by a transition of a clock signal, or amplitude enabled by the clock signal and the sensed current through the solenoid that reaches the defined maximum current.

2. The driver circuit of claim 1, wherein the high voltage level is greater than the defined maximum current for the solenoid multiplied by a characteristic resistance of the solenoid.

3. The driver circuit of claim 1, wherein the control circuitry is to turn the switch on at a plurality of fixed time intervals.

4. The driver circuit of claim 1, wherein the sensed current through the solenoid is sensed by a sensing resistor connected to the solenoid, and a reference voltage to which the voltage across the sensing resistor is to be compared.

5. The driver circuit of claim 4, wherein the reference voltage is variable based on one or more environmental condition or variation in mechanical performance of the solenoid.

6. The driver circuit of claim 1, wherein the defined maximum current is variable based on one or more environmental condition or variation in mechanical performance of the solenoid.

7. The driver circuit of claim 1, wherein the one or more capacitors form a capacitor bank.

8. The driver circuit of claim 1, further comprising:

the first power supply, as a boost power supply to provide the high voltage level to charge the one or more capacitors; and a second power supply, coupleable to the solenoid as a holding power supply to provide a holding current to the solenoid.

9. A driver circuit for driving a solenoid, comprising:

one or more capacitors;

a first power supply coupled to the one or more capacitors to charge the one or more capacitors to a high voltage level to over-drive the solenoid;

a second power supply, to supply a holding current to the solenoid;

a switch connected to the one or more capacitors and connectable to the solenoid; and control circuitry to turn the switch on so that the switch connects the one or more capacitors and the solenoid, and to turn the switch off so that the switch disconnects the one or more capacitors and the solenoid from each other in response to determining current through the solenoid achieves a defined maximum current.

10. The driver circuit of claim 9, wherein the high voltage level is defined as greater than a characteristic resistance of the solenoid times the defined maximum current for the solenoid.

11. The driver circuit of claim 9, wherein the control circuitry is clock driven to turn the switch on at fixed time intervals.

12. The driver circuit of claim 9, further comprising:

a sensing resistor coupled to the solenoid, for sensing the current through the solenoid; and a reference voltage, wherein the determining the current through the solenoid achieves the defined maximum current comprises comparing a voltage of the sensing resistor and the reference voltage.

13. The driver circuit of claim 12, wherein the reference voltage is variable.

14. The driver circuit of claim 9, wherein the control circuitry is further to determine the defined maximum current based on mechanical performance of the solenoid or at least one environmental condition.

15. The driver circuit of claim 9, wherein:

the one or more capacitors form a capacitor bank; and the switch comprises a transistor.

16. The driver circuit of claim 9, wherein the control circuitry to turn the switch on is clocked and edge enabled.

17. The driver circuit of claim 9, wherein the control circuitry to turn the switch on is enabled by an amplitude of a clock signal and a comparator for the determining the current through the solenoid reaches the defined maximum current.

18. A method of driving a solenoid, comprising:

charging one or more capacitors to a high voltage level to over-drive the solenoid;

turning a switch on, so that the switch connects the one or more capacitors to the solenoid;

turning the switch off, so that the switch disconnects the one or more capacitors from the solenoid, in response to a sensed current through the solenoid that reaches a defined maximum current;

repeating the turning the switch on and the turning the switch off, until the solenoid reaches an actuated state; and providing a holding current to the solenoid, with the solenoid in the actuated state.

19. The method of driving the solenoid of claim 18, wherein the repeating the turning the switch on is according to a clock.

20. The method of driving the solenoid of claim 18, wherein drive current into the solenoid comprises a series of pulses, terminated prior to first achieving the defined maximum current by a clock and subsequently by reaching the defined maximum current.

21. The method of driving the solenoid of claim 18, wherein the charging the one or more capacitors to the high voltage level to over-drive the solenoid comprises using a boost power supply.

22. The method of driving the solenoid of claim 18, wherein the repeating the turning the switch on and the turning the switch off comprises using a clock having a clock period that is smaller than a shortest characteristic time of the solenoid.

23. The method of driving the solenoid of claim 18, further comprising:

determining the defined maximum current based on mechanical performance of the solenoid or an environmental condition.

* * * * *